US006272076B1

(12) United States Patent
Dinger

(10) Patent No.: US 6,272,076 B1
(45) Date of Patent: Aug. 7, 2001

(54) ASTRONOMIC WATCH

(75) Inventor: Rudolf Dinger, Saint-Aubin (CH)

(73) Assignee: Asulab S.A., Bienne (CH)

( * ) Notice: Subject to any disclaimer, the term of this patent is extended or adjusted under 35 U.S.C. 154(b) by 0 days.

(21) Appl. No.: 09/283,303

(22) Filed: Apr. 1, 1999

(30) Foreign Application Priority Data

Apr. 9, 1998 (CH) ..... 0845/98
Jun. 5, 1998 (EP) ..... 98110269

(51) Int. Cl.[7] ..... G04B 19/26
(52) U.S. Cl. ..... 368/15
(58) Field of Search ..... 368/80, 15–19, 368/21–23, 28

(56) References Cited

U.S. PATENT DOCUMENTS

| | | | | |
|---|---|---|---|---|
| 4,435,795 | | 3/1984 | Frank . | |
| 4,681,459 | * | 7/1987 | Nabeyama et al. | 368/16 |
| 4,711,583 | * | 12/1987 | Oechslin et al. | 368/16 |
| 5,197,043 | | 3/1993 | Strader . | |
| 5,208,790 | * | 5/1993 | Sato | 368/15 |
| 5,457,663 | * | 10/1995 | Mejaski | 368/15 |

FOREIGN PATENT DOCUMENTS

| | | |
|---|---|---|
| 627 042 | 12/1981 | (CH) . |
| 0 652 498 | 5/1995 | (EP) . |
| 2 500 181 | 8/1982 | (FR) . |

* cited by examiner

*Primary Examiner*—Bernard Roskoski
(74) *Attorney, Agent, or Firm*—Sughrue, Mion, Zinn, Macpeak & Seas, PLLC

(57) ABSTRACT

The invention concerns astronomic watches capable of indicating the position of heavenly bodies of the solar system with respect to the Earth and to the zodiac.

The watch according to the invention is an electronic watch including: a time base (1) for generating a standard frequency signal, a circuit (2) for determining the current time and date from said standard frequency signal, this current date including the day of the month, the month and the year, a manual control system (7; 21, 22, 23) allowing each of said heavenly bodies to be selected, a display system (6; 14, 15, 16, 20), and means (3, 4, 5) for determining the position of a selected heavenly body with respect to the Earth and to the signs of the zodiac and for causing this position to be indicated by the display system.

Preferably the watch according to the invention is designed to allow the position of a heavenly body to be indicated at a date other than the current date which can be a past or future date.

The watch according to the invention has the advantage of being able to be made in the form of a compact watch such as a wristwatch.

14 Claims, 3 Drawing Sheets

12
10
19
23
25
15
18
17
14
21
19
22
20
24
13
18
16
24
11
12

ASTRONOMIC WATCH

BACKGROUND OF THE INVENTION

The present invention concerns an astronomic watch capable of indicating the position of heavenly bodies of the solar system at the current date and with respect to the Earth and the zodiac.

To the Applicant's knowledge, the only watch currently known which satisfies this definition is the mechanical wristwatch by the Ulysse Nardin S.A. company, called "Planetarium Copernicus".

This watch which is partially described in the document U.S. Pat. No. 4,825,426, includes a planetarium which permanently indicates the astronomic positions of the Sun, the Moon and five planets other than the Earth, with respect to the latter and to the zodiac, as well as the phases of the moon and the current date.

In order to do this and also of course to display the current time, in other words the legal time, the Ulysse Nardin watch is fitted with an extremely complex, very compact and very accurate mechanism, which makes it practically a prohibitively expensive watch.

On the other hand, given the number of data displayed, it is not always easy to read such data and although one has attempted to reduce the dimensions of the watch as much as possible, it remains nonetheless distinctly more voluminous than a conventional wristwatch.

SUMMARY OF THE INVENTION

The object of the invention is to provide a watch, in particular a wristwatch, which enables a user to know, at any time, when he so wishes, the position of a heavenly body of the solar system in the zodiac without the watch having the drawbacks which have just been mentioned. This object is reached due to the fact that the watch according to the invention is an electronic watch including a time base for generating a standard frequency signal, a circuit for determining the current time and date from this standard frequency signal, said current date including the day of the month, the month and the year, a manual control system allowing each of said heavenly bodies to be selected, a display system and means for determining the position of a selected heavenly body with respect to the Earth and the zodiac and to cause this position to be indicated by said display system.

In particular embodiments of the invention the heavenly bodies whose position can be indicated include the Sun and the eight solar planets other than the Earth.

Moreover, in these particular embodiments, the watch can also indicate the phases of the moon.

On the other hand, for different reasons, it can be advantageous or useful to know quickly what was or what will be the position of one or more heavenly bodies of the solar system at a date other than the current date and more or less distant from the latter.

Another object of the invention is to provide an astronomic watch which also offers this possibility.

BRIEF DESCRIPTION OF THE DRAWINGS

Other characteristics and advantages of the watch according to the invention will appear upon reading the following description which refers to the annexed drawings in which.

DESCRIPTION OF THE INVENTION

Figure 1:
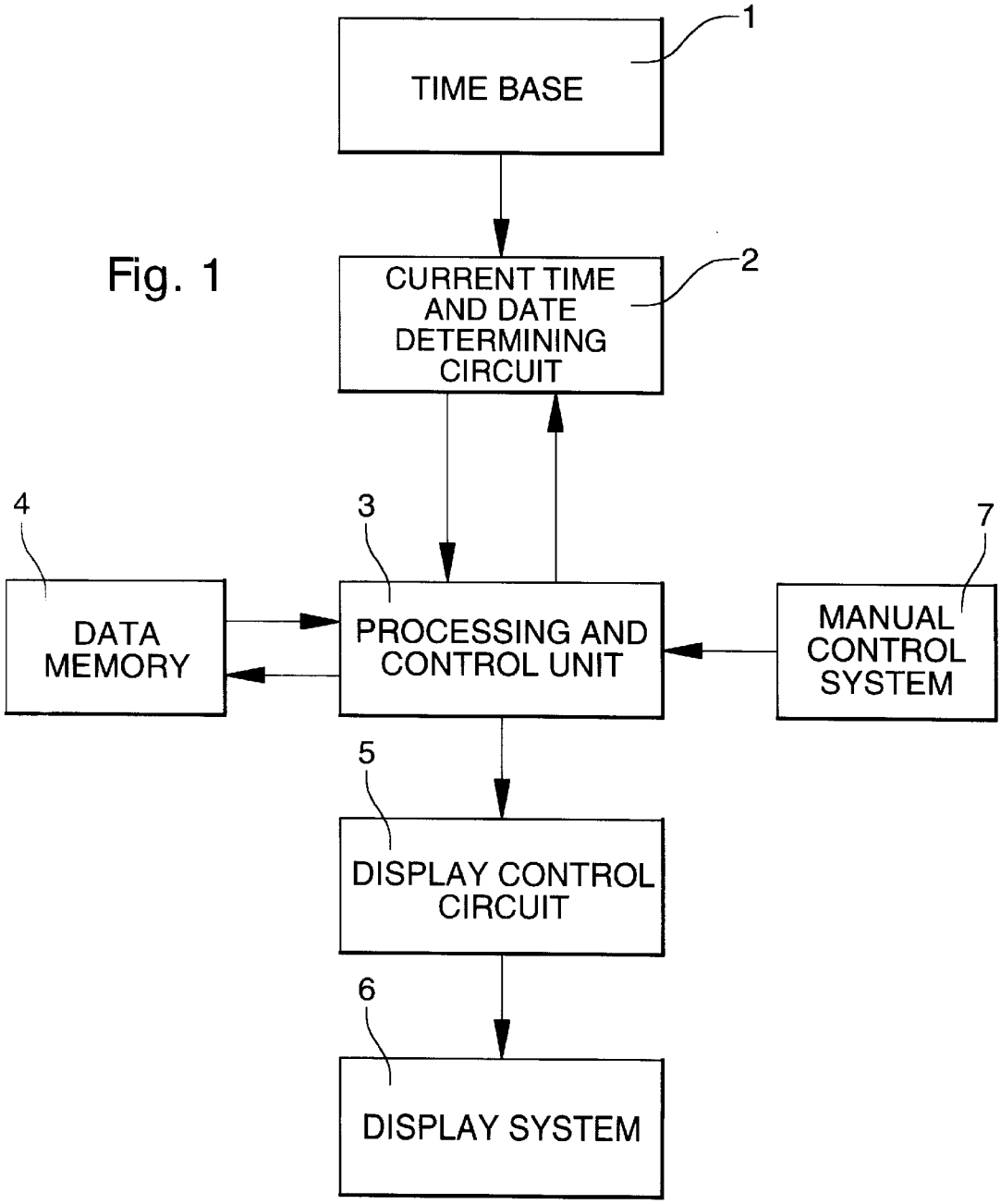
FIG. 1 is a block diagram which shows generally a possible embodiment of the watch according to the invention.

The watch according to the invention, which is shown schematically in FIG. 1, includes a time base 1, a current time and date determining circuit 2, a processing and control unit 3 with which a data memory 4 is associated, a display control circuit 5, a display system 6, a manual control system 7 and a direct voltage supply source, for example a battery, which is not shown.

Time base 1, which provides a standard frequency signal to time and date determining circuit 2, can advantageously be formed by a quartz oscillator of the type conventionally used in electronic watches which is formed by a quartz resonator and a maintaining electronic circuit which enables the resonator to vibrate at a frequency of 32768 Hz.

Current time and date determining circuit 2 includes a frequency divider, a second counter if necessary, and counters for the minutes, hours, days of the month, months and years and possibly centuries and millenniums. This circuit 2 can also include a counter for the days of the week if they are also indicated by the watch.

Moreover, circuit 2 contains the means necessary, on the one hand, to take account of the months of 28, 29, 30 and 31 days, in other words so that the watch is provided with a perpetual calendar and, on the other hand, to allow corrections to be made to the time and the date via processing and control unit 3 to which this circuit is connected.

Finally, circuit 2 is also designed to provide unit 3, and thereby display control circuit 5, with all the periodic signals generated by its frequency divider and which are needed by said unit 3 and circuit 5 to fulfil their different functions.

Among the functions of unit 3, is that which consists of determining, upon the user's request, the positions of different heavenly bodies of the solar system other than the Earth, with respect to the latter and to the zodiac, at a determined date which in the simplest case can be only the current date but which, preferably, can also be another past or future date selected by the user.

For this purpose, unit 3 includes a processor (not shown) which uses memory 4 which is a non-volatile memory programmed by the watch manufacturer and in which are stored all the parameters concerning the zodiac and the relative movements of the heavenly bodies of the solar system with respect to the Earth needed by this processor (synodic revolution periods of the planets, synodic lunar month, etc.).

Further, the calculations which the processor of unit 3 has to perform in order to determine the positions of the heavenly bodies by using these parameters are well known to those skilled in the art and there exist numerous works which can be consulted if required to program this processor properly. Among these works, one can cite "Astronomical Algorithms" by Jean Meeus, published by Willmann-Bell, Inc., Richmond, Va. 23235 in 1991 and "Landolt-Börnstein; Numerical Data and Functional Relationships in Science and Technology", group IV, volume 1, Springer Verlag, Berlin 1965.

Naturally, if the watch is designed to provide other astronomic data like for example the phases of the Moon and/or the eclipses of the Moon and the Sun, memory 4 also includes all the data necessary for the processor which is also programmed accordingly.

Manual control system 7 includes one or more control members which can be moving members such as pushbuttons, a rotating stem with several axial positions or a rotating bezel or fixed members such as capacitive or resistive sensors.

When necessary, control system 7 also includes the transducers which allow generation of electric control signals representative of the state in which the control member or a control member is situated and/or the manipulations to which this member is being subjected. In the case of a control stem for example, the circuit breakers or switches which are actuated by this stem when it is moved axially and rotated in one direction or another, form part of the control system.

In all cases, the signals generated by this system are transmitted to processing and control unit 3 to allow time or date data to be selected, corrected or more generally modified, to cause the watch to pass from one operating mode to another, to select a heavenly body, cause its position to be indicated, etc.

As regards display system 6, it can be only analogue or only digital or both together.

As will be seen hereinafter, when it is purely analogue, system 6 can if necessary include only two hands for selectively displaying the current time, the current date or another date, the positions of the heavenly bodies of the solar system with respect to the Earth and the zodiac and possibly other data such as the phases of the Moon.

Conversely, there can be three hands for indicating the time, including the seconds, at least three hands for indicating the dates (days of the month, months, years) and at least one hand for the position of the heavenly bodies and the other astronomic data.

Between these two extremes, there are obviously intermediate solutions such as for example that which consists in having two hands for selectively indicating the time and the positions of the heavenly bodies and three others for the dates, which allows the current date to be permanently able to be read.

Having said this, it is obvious that display system 6 can be only analogue but include members other than hands, for examples discs or rings provided with indexes.

On the other hand, whatever the display elements, system 6 also includes stepping motors and the gear trains that drive them.

When system 6 is solely or also digital, it includes at least one electro-optical display cell, preferably a liquid crystal cell.

If the watch has both an analogue and digital display, it is possible that this cell only has to display data in digital form, such as for example date information.

Conversely, when the watch is solely digital, the cell or cells of its display system 6 must be capable of displaying all the time and astronomic data that the watch has to provide in alphanumeric form and possibly using symbols. Naturally, as regards the presentation of this data, there exists a multitude of possibilities.

Display control circuit 5 is used to convert the logic signals which it receives from processing and control unit 3 into driving signals for display system 6.

When this system is analogue this can be effected by a decoding circuit, one or more pulse shaping circuits for generating display control pulses and one or more circuits for converting the latter into driving pulses and applying them selectively to the motors which drive the display members.

If system 6 is solely digital, circuit 5 can be formed of a decoding circuit and one or more driving circuits for applying the necessary potential differences across the different electrodes of the electro-optical cell or cells.

Finally, if display system 6 is mixed, control circuit 5 can be formed by a combination of these different types of circuits.

In any event, the resonator maintaining circuit included in time base 1, circuit 2, unit 3, memory 4 and circuit 5 can advantageously be made in the form of an integrated microcontroller.

The operation of the watch of FIG. 1 will not be described, even generally, since as it depends to a very large extent upon the type and form of its display system 5, this would mean numerous possibilities would have to be envisaged and would require a long complicated description which would not be useful for the comprehension of the invention by those skilled in the art.

Figure 2:
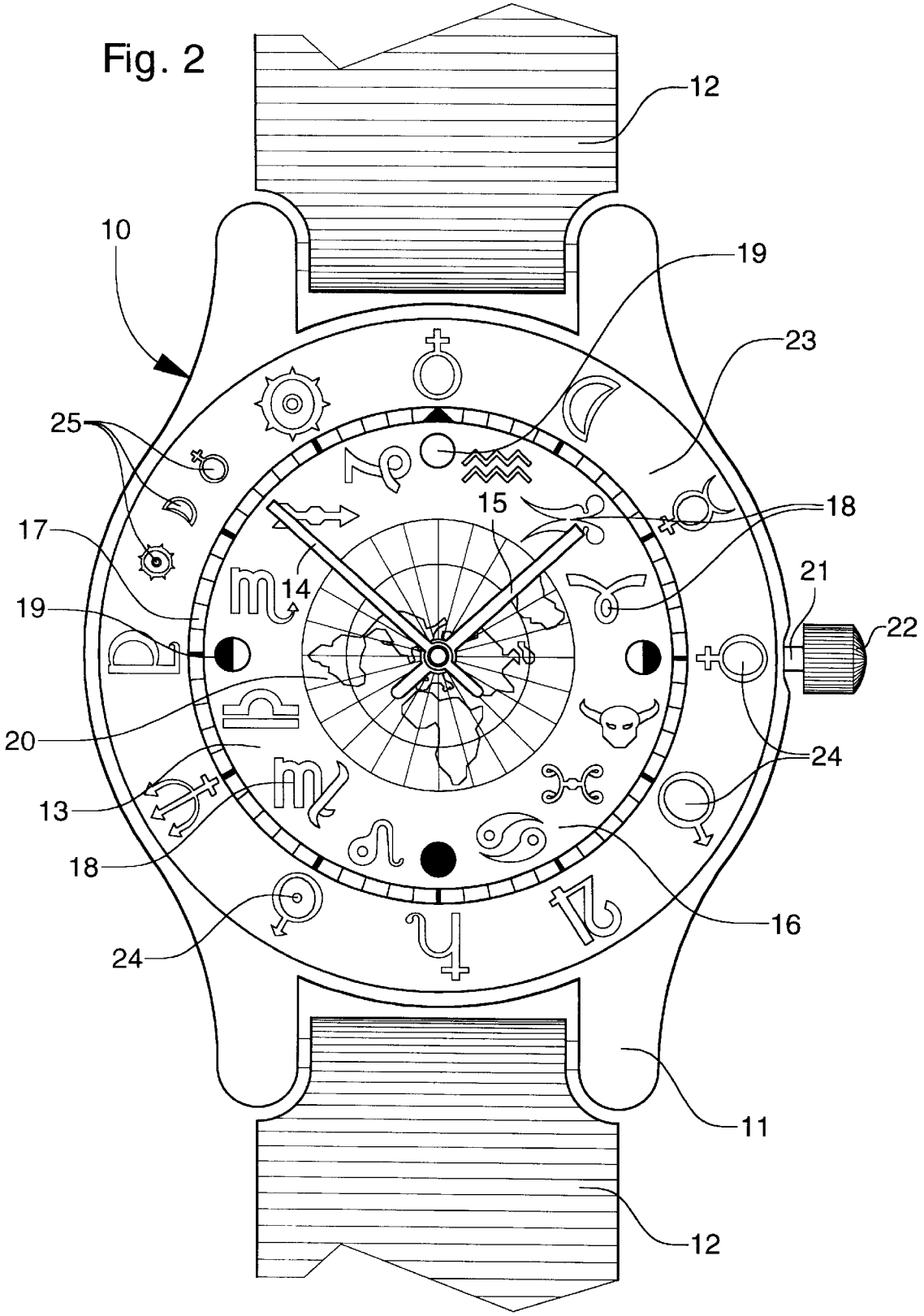
FIGS. 2 and 3 are front views of two particular embodiments of the watch shown in FIG. 1.
Figure 3:
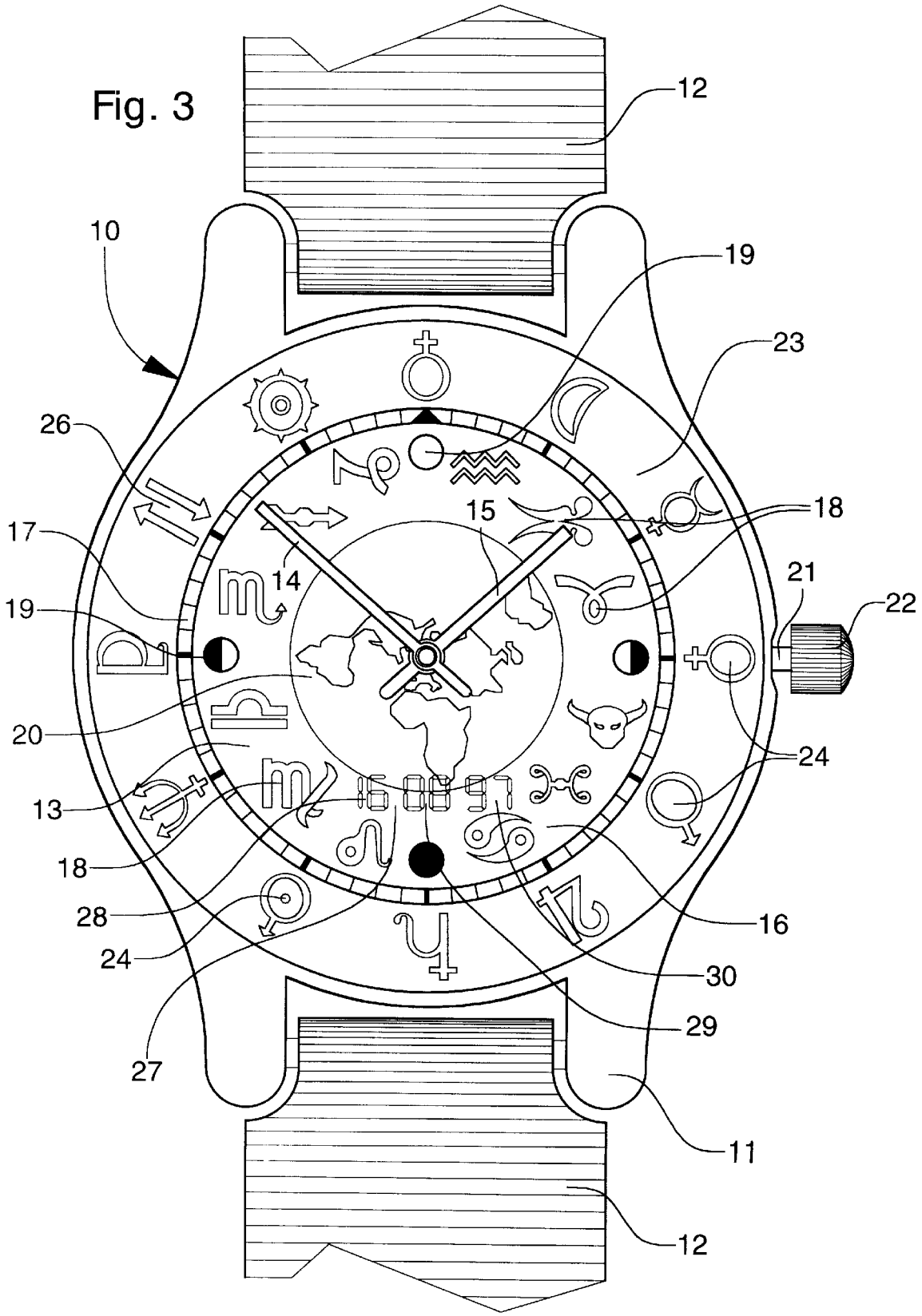

This description will thus only be made within the scope of the embodiments shown in FIGS. 2 and 3.

FIG. 2 shows a first particular embodiment of the watch which has just been described with reference to FIG. 1.

The watch of FIG. 2 is an analogue display wristwatch which includes in a conventional manner a case 10 formed by a middle part 11 to which are attached the two ends or the two strands of a wristlet 12, a crystal 13 fixed to the front of this middle part and a back cover which is not visible in the drawing, which can be removable or provided with a hatch allowing a battery, which is used as a source of supply voltage for the watch, to be introduced and changed.

On the other hand, the watch of FIG. 2 is designed to be able to indicate the position in the zodiac of the Sun and the planets other than the Earth, as well as the phases of the Moon, at a determined date which can be the current date or any other past or future date, comprised within a period of one hundred years, this period of time being able to be for example from 1951 to 2050.

In an alternative, the watch could also be designed to indicate the zodiacal position of the Moon.

Display system 6 of the watch of FIG. 2 includes an hour hand 14 and a minute hand 15 which are each driven by a stepping motor in two directions of rotation by a suitable gear train.

These two hands 14 and 15 move above a dial 16 in the shape of a ring which carries at the periphery thereof an hour and minute scale 17 and inside the latter the symbols 18 of the twelve signs of the zodiac, as well as the representations 19 of the four main phases of the Moon which are: full moon, the first quarter, the new moon and the second quarter and which are situated respectively at 12 o'clock, 9 o'clock, 6 o'clock and 3 o'clock.

Naturally, symbols 18 for the signs of the zodiac could very well be replaced by pictograms more representative of their names which are also often used or by their names themselves or even by abbreviations thereof.

Moreover, as the drawing shows, dial 16 surrounds a planisphere 20 which represents a map of the world seen from one of the poles, in this case the North Pole, and which is divided into 24 sectors corresponding to the 24 time zones.

This planisphere is carried by a disc which rotates about the same axis as hands 14 and 15 and which is mechanically coupled to the gear train driving hour hand 14 so as to effect one revolution in 24 hours in the anticlockwise direction.

In this first particular embodiment, manual control system 7 of the watch includes a control stem 21 provided with a crown and a rotating bezel 23.

Control stem 21 is a rotating stem which can be moved axially between three positions, namely a stable neutral position which corresponds to the normal operation of the watch, a pulled out position which is also stable and an unstable pushed in position in which a return spring permanently tends to return the stem to the neutral position.

The axial and rotating movements of this stem 21 are converted by switches into characteristic electric signals which are sent to processing and control unit 3 of the watch.

As regards the rotational movements, these electric signals are pulse trains which allow the control and processing unit to determine in which direction the stem is being rotated and whether the rotational speed is less or greater than a certain value, in other words whether the stem is being rotated slowly or quickly.

Rotating bezel 23 carries large symbols 24 for the Sun, the Moon and the planets, and smaller symbols 25, in a zone situated between two of these symbols 24, the repeated symbols 25 for the Earth, the Sun and the Moon.

The position of bezel 23 can be detected by any known device connected to processing and control unit 3 of the watch, as for example that of the universal watch which is disclosed in the document EP-A-0 738 944 and which is formed by magnets included in the bezel and Reed contacts placed within the watch.

On the other hand, it is obvious that, like symbols 18 for the signs of the zodiac on the dial, symbols 24 and 25 for the heavenly bodies on the rotating bezel could be replaced by the names of these heavenly bodies or any other representation enabling them to be distinguished.

In this embodiment of FIG. 2, hands 14 and 15 are used not only for indicating the current time, but also for displaying all the other data which the watch can provide. It is thus necessary for processing and control unit 3 to know at all times the position of each of these hands in order to know how much they have to be moved to pass from the display of the current time to that of one or more other data and vice versa.

For this purpose, unit 3 contains a minute counter and an hour counter identical to those of current time and date determining circuit 2 and whose states determine and represent respectively the positions of the minute and hour hands. Moreover, the binary logic signals which represent the contents of these hand position counters are permanently transmitted to display control circuit 5.

For the same reason, unit 3 also contains the means, in particular two comparators, which allow the minute and minute hand position counters on the one hand and the hour and hour hand position counters on the other hand, to have the same contents when the watch indicates the current time and when this latter is modified or conversely the minute and hour hand position counters to have different contents to those of the minute and hour counters when said hands have to display other data.

Such means have already been described in numerous documents concerning multi-function analogue watches in which the hour, minute and where appropriate, second hands are used to provide temporarily and selectively other data than the current time, such as for example a pre-programmed alarm time, the current date or a timed time.

Finally, it should also be noted that in this embodiment of FIG. 2, all the counters mentioned so far are reversible counters and the year counter of the current time and date determining circuit is divided into a counter for the units and a counter for the tens. The reason for this separation will appear hereinafter.

Having said this, the watch of FIG. 2 operates as follows:

When control stem 21 is in the neutral position and when the large symbol 24 for the Earth on the bezel is at 12 o'clock, the watch operates normally and hands 14 and 15 display the current time.

More precisely, the minute counter of circuit 2 and the minute hand position counter of unit 3, whose contents are at that time the same, simultaneously receive from the frequency divider which his also included in circuit 2, pulses of 1/60 Hz which allow them to be incremented each time by one unit.

In turn, these minute and minute hand position counters generate every twelve minutes pulses which increment the contents of the hour and hour hand position counters which are also the same and the binary signals which represent the contents of the hand position counters are converted by display control circuit 5 into driving pulses so that the motors of display system 6 cause minute hand 15 to advance by one step per minute and hour hand 14 to advance by one step every twelve minutes.

Conversely, the contents of the counters for days of the month, the months and the years of circuit 2 which are then progressively incremented by the pulses generated every hour by the hour counter of the same circuit are not normally displayed.

If the user wishes to know the day of the month, he has to exert pressure briefly on control stem 21 in order to actuate a switch of control system 7 and thus to send a short pulse to unit 3.

In response to this pulse, unit 3 interrupts the transmission of pulses of 1/60 Hz from the frequency divider of circuit 2 to its minute hand position counter and transfers the content of the days of the month counter of this circuit into its minute hand position counter 15.

Display control circuit 5 reacts to this change in content of the minute hand position counter 15 by sending driving pulses of much higher frequency than the norm to the driving motor of said hand, so that it rotates rapidly in one direction or in the other so as to come by the shortest route to face the mark of scale 17 of dial 16 of the watch which corresponds to the day of the month of the current date. If for example this day is the 27th, hand 15 moves into the position in which it normally indicates 27 minutes.

Then, after several seconds, in order to allow hand 15 to come automatically back into the position in which it indicates the minutes of the current time, the contents of the minute and minute hand position counters are compared by unit 3 and the position counter is incremented or decremented until the content thereof is equal to that of the minute counter. Simultaneously, the connection between the output of the frequency divider of circuit 2 and the minute hand position counter is re-established.

Further, given that the content of the hour hand position counter may have been disturbed during this change of mode, this content is also compared to that of the hour counter in order to equalize the two.

If, when the watch is in normal operating mode, the user does not exert brief pressure on stem 21, but pulls it to bring it into the pulled out position, the watch passes into current time correcting mode. When the user rotates stem 21, unit 3 uses the first pulses generated by control system 7 to determine, on the one hand, whether the rotational speed of the stem is less or greater than a determined value and, on the other hand, whether the stem is being rotated in one direction or the other.

If the stem is being rotated slowly, unit 3 interrupts first the transmission of output pulses from the frequency divider of circuit 2 to the minute counter of the same circuit and to its own minute hand position counter 15. Then, unit 3 generates correction pulses the number and frequency of which correspond to the movement of rotation of the stem to these two counters in order to increment or decrement the content thereof and cause the minute hand to go forwards or backwards via display control circuit 5, according to the rotational direction of the stem, after which the connection between the frequency divider and the minute and minute hand position counters is re-established when the stem is returned to its normal position.

If conversely, the unit detects that the stem is being rotated rapidly, the connection between the frequency divider and the minute and minute hand position counters is not interrupted and unit 3 generates and applies to the inputs of the hour counter and the hour hand position counter 14 a number of pulses of high frequency which allows this hand to move forwards or backwards by one hour, always according to the rotational direction of the control stem and each time that the latter is subjected to a rapid rotation.

Moreover, it is obvious that a modification of more than 12 minutes automatically involves modification of the hour indication.

When the user wishes to know the position of the Sun, or a planet other than the Earth in the zodiac, at the current date, he rotates bezel 23 until symbol 24 for the heavenly body which interests him is at 12 o'clock and he then presses on crown 22 of stem 21.

Processing and control unit 3 which permanently knows the position of bezel 23 then blocks the pulses from the frequency divider at the input of the minute hand position counter thereof, then after having performed the operations necessary to determine the position of the selected heavenly body in the zodiac, it modifies the content of this counter so that the minute hand moves in one direction or the other to come to be placed in the position in which it simultaneously indicates the sign of the zodiac in which this heavenly body is situated and the approximate position of the latter within the sign in question, by using respectively symbols 18 and hour and minute scale 17 of dial 16.

If he wishes, the user can then repeat the same operations for one or more other heavenly bodies. If not, he needs only to replace bezel 23 so that symbol 24 for the Earth is situated at 12 o'clock in order for the contents of the hand position counters to be compared and equalized with those of the minute and hour counters of circuit 2 and for minute hand 15 and possibly the hour hand return to the position in which they indicate the current time.

In the case of the Moon, the watch displays the phase by means of minute hand 15. If this phase is not one of the four main phases which are represented by symbols 19 on the dial, the minute hand moves to an intermediate position which allows the number of days which separate the phase at the current date from the preceding or following main phase to be known.

On the other hand, in the previously envisaged variant, the watch can simultaneously indicate the zodiacal position of the Moon and the phase thereof. In this eventuality, and for a question of rationality, the zodiacal position can be displayed by the minute hand and the phase by the hour hand.

In the following description to avoid repetition, it will be assumed that each time that the minute hand and if necessary the hour hand are used to provide one more data items other than a time, the connection between the output of the frequency divider of circuit 2 and the minute hand position counter is interrupted and that after the hands have displayed this data, the contents of the hand position counters are compared and equalized automatically or upon command, with the minute and hour counters of circuit 2 in order to return the hands into the position in which they indicate the current time.

Having said this, in order to know the zodiacal position of a solar heavenly body other than the Earth, at a date other than the current date, the user has to begin by introducing this date into the watch.

In order to do this, when the small symbol 25 for the Earth which is on bezel 23 is brought to 12 o'clock the content of the days of the month counter of circuit 2 is transferred into the minute hand position counter and the minute hand indicates the current day of the month by using the 31 first minute indexes of scale 17 on the dial. The day of the month can then be modified by bringing stem 21 into the pulled out position and by rotating it slowly in one direction or the other.

Likewise, positioning of the small symbol 25 for the Moon at 12 o'clock causes the transfer of the content of the month counter into the minute hand position counter and the display of the current month by this hand using the 12 first minute indexes of the scale and pulling stem 21 out then rotating it slowly allows another month to be selected.

Finally, when the small symbol 25 for the Sun is brought to 12 o'clock the two hands indicate the two last figures of the current year by using the hour indexes of scale 17. More precisely, the contents of the units and tens of years counters of circuit 2 are then transferred by being modified into the minute and hour hand position counters of unit 3 so that the minute hand displays the units and the hour hand displays the tens. When the hands are in this position another year can be selected by putting stem 21 in the pulled out position and rotating it slowly to move the minute hand and rapidly to move the hour hand.

In all cases the number of the selected day, month and/or year is stored by unit 3 of the watch when the stem is returned to its neutral position, the return of the stem to this position also causing the return of hands 14 and 15 to the positions in which they indicate the current time.

When he has finished programming a date, the user can obtain from the watch the astronomic data which interest him by acting in exactly the same way as for the current date. When he has finished and he returns symbol 24 for the Earth to 12 o'clock, the hands take their normal position again and the date which was stored by unit 3 is erased.

Given that the watch is provided with a perpetual calendar, the current date must only be corrected when the battery is changed. In order to set the date, the user or the person who changes the battery proceeds in the same way as has just been described to select a date other than the current date except at the end when he must exert a prolonged pressure on stem 21, for the watch to store the selected date as the current date.

Having said this and to end the description of the watch of FIG. 2, the function of planisphere 20 remains to be explained.

This planisphere is used to indicate the half of the Earth which is in darkness and that which is illuminated by the Sun at the time indicated by the hands assuming that the Sun is at 12 o'clock.

As has already been explained, the disc which carries this planisphere is mechanically coupled to the driving gear train of hour hand 14 so as to effect one revolution every 24 hours in the anti-clockwise direction. Consequently, planisphere 20 moves at the same time as the hour hand not only when it indicates the current time and when the time indication is modified by the user, which is entirely normal, but also when this hand is used to select a year other than the current year. This is not very inconvenient. However, this slight inconvenience can be removed by driving the disc on which the planisphere is situated by a third motor independent of those which drive the hour and minute hands. Another possibility for avoiding this would consist in displaying the years not simultaneously by the two hands but successively by the minute hand.

On the other hand, in order to allow the half of the Earth illuminated by the Sun to be better distinguished from that which is in darkness, the portion of crystal 13 which is above the latter could for example be more or less tinted or made slightly translucent.

Finally, as has already been specified, in the embodiment of the watch of FIG. 2, as it has been described, the period of time during which the positions in the zodiac of the heavenly bodies seen from the Earth and the lunar phases can be indicated is one hundred years. This is mainly due to the fact that only the last two figures of a year are taken into account in order to allow them to be simultaneously displayed by the hour and minute hands of the watch alone.

This method allows the user to read and select a year rapidly and without risk of error, while limiting the number of axial positions of the control stem.

The previously mentioned possibility which would consist of only using the minute hand for indicating successively the figures of a year would also allow the duration of the period of time in question to be increased to one or even several millenniums. Naturally, in this case the watch would have to be fitted with at least one century counter and possibly a millennium counter.

As regards the user, the selection of a year by four figures and the correction thereof would not be any more difficult. These operations would be above all longer. Conversely, reading of a year would become substantially more complicated and uncertain.

If the watch included a second hand also driven by an independent motor, it would be possible to reach more or less the same result. In this case, a year could be displayed simultaneously by the three hands, but the watch would then be more complicated and more voluminous and would become more expensive. Moreover, the way of controlling the watch by the stem would have to be modified possibly by providing a second pulled out position.

The watch of FIG. 3 is a wristwatch with both an analogue and digital display, which is designed to provide the same time and astronomic data as the watch of FIG. 2, and which has numerous common features with the latter.

Like the watch of FIG. 2, the watch of FIG. 3 includes a case 10 with a middle part 11 to which a wristlet 12 is attached, a crystal 13 and a back cover which is not visible in the Figure.

The display system of the watch of FIG. 3 also includes an hour hand 14 and a minute hand 15 each driven by a two-directional stepping motor, as well as an annular dial 16 with a peripheral hour and minute scale 17 and within the latter the symbols 18 of the twelve signs of the zodiac and the representations 19 of the four main phases of the Moon.

Conversely, in this watch of FIG. 3 it is no longer the hands which are used to display the current date or any other date included within a period of one hundred years, but a liquid crystal cell 27 which is totally transparent when it is not activated and which is incorporated in crystal 13 or placed at the back thereof.

As can be seen in the Figure, this cell includes three pairs of digits 28, 29 and 30 for displaying respectively the days of the month, the months and the last two figures of the years.

In order for the watch to maintain as much as possible the appearance of an analogue watch, the date is not permanently displayed, but only upon command and by milky coloured figures. Moreover, this manner of displaying the date allows the portion of central planisphere 20 situated behind a portion of the display zone of the cell to be masked as little as possible. Conversely, in order to facilitate reading of the date, in this embodiment, planisphere 20 no longer bears the links dividing it into 24 zones.

On the other hand, in order to control cell 27, display control circuit 5 includes in addition to the means which are used to control the driving motors for hands 14 and 15 and which are the same as those of circuit 5 of the purely analogue watch of FIG. 2, a decoding circuit which receives the binary logic signals which are applied thereto by processing and control unit 3 and a driving circuit for applying selectively the necessary potential differences across the cell control electrodes.

The binary logic signals which can be applied to circuit 5 by unit 3 come from three digital display state counters included in said unit. These counters which are counters for the days of the month, the months and years play the same role as the minute and hour hand position counters of the embodiment of FIG. 2 and which are also found in this embodiment of FIG. 3.

More precisely, according to the operating mode of the watch, these counters may or may not be connected to the output of the hour counter of current time and date determining circuit 2 depending on whether the current date is to be displayed or corrected or another date is to be selected and temporarily stored. Moreover, the contents of these state counters can be equalized as a result of means for comparison and compensation with those of the corresponding counters of circuit 2 which permanently represent the current date.

As regards its manual control system, the watch of FIG. 3 includes the same three position control stem 21 as that of the watch of FIG. 2, as well as a rotating bezel 23 with the same symbols 24 for the Sun, the Moon and the planets and the same angular positions which they indicate. The only difference is that in the watch of FIG. 3 the three positions of the bezel which correspond to the small symbols 25 for the Earth, the Moon and the Sun are replaced by a single position indicated by a symbol 26 formed of two parallel arrows having opposite directions.

When one wishes to display the current time, to modify such time indication and to show, by means of planisphere 20, the half of the Earth illuminated by the Sun and the half in darkness, the operation of the watch of FIG. 3 is identical to that of the watch of FIG. 2.

On the other hand, when rotating bezel 23 is positioned so that the symbol 24 for the Earth is at 12 o'clock and if the control stem is in the neutral position, in other words when the watch is operating normally, the digital display state counters of unit 3 are incremented normally, like the date counters of circuit 2, by the output pulses of the hour counter of this same circuit 2. But the binary logic signals of the state counters are not transmitted to display control circuit 5, which means that liquid crystal cell 27 does not display any date. Despite this, if the user wishes to know the position in the zodiac of one or more heavenly bodies other than the Earth at the current date, he need only manipulate bezel 23 and control stem 21 in the same way as with the watch of FIG. 2 for minute hand 14 and as appropriate hour hand 15 to provide the data which he desires also in the same way.

If the user simply presses quickly on stem 21 when the watch is operating normally unit 3 establishes the connection between the binary outputs of its display state counters and the decoder of circuit 5 and cell 27 then displays the current date.

If after a determined period of time, of several seconds, the user has done nothing further, the connection is interrupted and the date is automatically erased.

Conversely, if during this period of time, the user rotates bezel 23 so as to bring the two arrows 26 to 12 o'clock, the date remains displayed and can then be modified.

In order to do this, a first short pressure on control stem 21 allows, on the one hand, the connection between the output of the hour counter of circuit 2 and the display state counters of unit 3 to be interrupted and, on the other hand, the two first digits 28 of cell 27, which indicate the day of the month, to be selected and made to flash. By pulling on stem 21 and rotating it slowly in one direction or the other, the user can then cause unit 3 to modify the content of its days of the month state counter, and to block and store such content.

Likewise, the user can then, again by quickly pressing on the control stem, select and cause to flash the two digits 29 of the cell indicating the month then pull the stem into the pulled out position and rotate it to select the month which he desires and store this month by returning the stem to the neutral position.

Finally, to select a year, the user can again exert a short pressure on the stem to select the corresponding digits 30, rotate the stem after having pulled it out and store this year by returning the stem to the neutral position.

However, given that in the case of years selection can be considerably longer than for the days of the month and the months, the user can then modify the units by rotating the stem slowly and the tens by rotating it quickly, as he can do in order to correct the minutes and the hours displayed by the hands of the watch.

After having selected a date, the user can then cause the hands of the watch to indicate the zodiacal position of one or more heavenly bodies and possibly the phase of the Moon by acting on rotating bezel 23 in the same way as with the watch of FIG. 2.

After this, the user has only to return the rotating bezel to the position in which the symbol for the Earth is at 12 o'clock for the contents of the hand position counters and the display state counters of unit 3 to be compared and equalized with the corresponding current hour and date counters, for the connection between the binary outputs of the display state counters of unit 3 and display control circuit 5 to be interrupted and for the watch to begin to operate normally again.

Finally, as in the particular embodiment of the watch of FIG. 2, the fact of bringing bezel 23 into the position in which the symbol of double arrow 26 is at 12 o'clock also allows the date to be corrected after a change of battery. In order to do this, one needs only to proceed in the same way as for the modification of the current date and to exert a long pressure on stem 21 before returning the bezel to the position in which the symbol for the Earth is at 12 o'clock. In this case, correction pulses generated in response to rotations of the stem are applied both to the date counters of circuit 2 and to the display state counters of unit 3.

Naturally, in this embodiment of FIG. 3, it would also be possible to increase to a very large extent the period of time during which the zodiacal positions of the solar heavenly bodies and the phases of the Moon could be indicated.

In order to do this, the watch could be fitted with a display cell with two additional digits for the centuries and millenniums, placed in front of those for the years and decades and which would display the content of corresponding counters. The figures displayed by these digits could then be modified by using the control stem in the same way as the other pairs of figures and unlike what could be done with a purely analogue watch, such as that of FIG. 2, the reading of the year indicated by four figures would obviously not be any more difficult for the user, nor more uncertain than that of a year indicated only by two figures.

Independently of this, rather than being incorporated in the crystal or placed behind the latter, the cell could be situated at the back of the watch and visible through a window made in the back cover of the case. The current date could then be permanently indicated, by a cell which would preferably display in a dark colour on a light background and which would provide a very good contrast. Reading of this current date or any other date displayed by the cell during a selection would then be easier for the user. Moreover, the main face of the watch would constantly have the aesthetic appearance of a purely analogue watch. However, in order to avoid the user being obliged to take his watch off his arm or to turn it over if the wristlet thereof allowed, it would be preferable in this case to make the case and the case-wristlet connection as it is known to do for a double-face watch, such as for example those which display the time on one side in analogue form and in digital form on the other side.

Having said this, it is obvious that the invention is not limited to the general and particular embodiments which have been described nor to the variants thereof which have been envisaged.

For example, in variants of the watches of FIGS. 2 and 3, the planisphere could be omitted and in the case of the watch of FIG. 3 the display cell could be placed behind the dial and be visible through a window in such dial. The current date could then be permanently displayed when the watch operates normally and reading and modification of such date would then be easier for the user than if the cell was placed at the back of the watch, as has already been envisaged. Of course, this would mean attributing a little more importance to the practical aspect of the watch and a little less to the aesthetic appearance thereof.

On the other hand, in simplified versions, the watch could simply indicate the sign of the zodiac in which a heavenly body is situated at a determined date, without specifying, even approximately, the position of such heavenly body within such sign.

Moreover, in the case of an analogue or mixed display watch, when the minute and hour hands are not used to indicate anything other than the current time in the time zone in which the user is situated or possibly in another time zone, it would not be necessary to provide a current time and date determining circuit with minute and hour counters, nor a processing and control unit with position counters for such hands. The display control circuit could then receive directly from the frequency divider of the current time and date determining circuit standard frequency signals of 1/60 or 1/30

Hz to allow the display circuit to drive the hands using a single motor, preferably a two-directional motor to allow more rapid time corrections.

It is to be noted that this comment also applies to a watch with a second hand, in which this hand would only be used for displaying the seconds except that the standard frequency delivered by the frequency divider of the current time and date determining circuit would then be 1 Hz.

Finally it is obvious that the invention can be applied to watches which do not simply display the time and the date, but also to watches capable of fulfilling other functions, such as alarm, chronograph, timer functions, and others.

For example, in the particular case of an analogue display chronograph watch, the hands for the chronograph function could be used to indicate a date and/or the position of a heavenly body with respect to the zodiac, when this function is not being used.

What is claimed is:

1. An astronomic watch capable of indicating the position of heavenly bodies of the solar system at the current date with respect to the Earth and to the zodiac, this watch being an electronic watch and including:

a time base for generating a standard frequency signal;

a circuit for determining the current time and date from said standard frequency signal, said current date including the day of the month, the month and the year;

a manual control system allowing each of said heavenly bodies to be selected, a display system, and means for determining the position of a selected heavenly body with respect to the Earth and to the signs of the zodiac and for causing this position automatically to be indicated by said display system;

wherein said watch is designed to allow a date other than the current date to be selected, and to determine and cause to be indicated by said display system the position of a selected heavenly body at this other date which can be a past or future date, wherein said display system includes an hour hand and a minute hand co-operating with a dial, which indicate the current time when the watch is in normal operating mode, and wherein one of said hands is also used to indicate upon command the position of a selected heavenly body at said current date or at said date other than the current date.

2. An astronomic watch according to claim 1, wherein the hand indicating the position of the selected heavenly body is the minute hand, in cooperation with representations of the signs of the zodiac carried by the dial and an hour and minute scale of this same dial.

3. The astronomic watch according to claim 1, wherein said heavenly bodies of the solar system include the Sun and the either planets other than the Earth.

4. An astronomic watch according to claim 3, designed to determine and indicate also the phases of the Moon.

5. An astronomic watch according to claim 4, wherein said heavenly bodies also include the Moon.

6. The astronomnic watch according to claim 1, wherein said means for determining comprises:

memory means for storing parameters concerning the zodiac and the relative movements of said heavenly bodies with respect to the earth; and processing and control means, responsive to said parameters and the current data provided by said circuit for determining the current time and date, for calculating said position of said selected heavenly body and for causing said position to be indicated by said display system.

7. The astronomic watch according to claim 1, this watch being a wristwatch.

8. An astronomic watch according to claim 2, wherein said minute and hour hands are also used for sequentially indicating upon command the day of the month, the month and the year of said current date and said other date.

9. An astronomic watch according to claim 2, wherein said display system also includes an electro-optical display cell for simultaneously indicating the day of the month, the month and the year of said current date and said other date.

10. An astronomic watch according to claim 9, including a case with a crystal, wherein the display cell is incorporated in said crystal or fixed to the back thereof, wherein this cell is transparent when the watch is operating normally and wherein this cell only displays upon command the current date when it is only a question of reading it or selecting another date.

11. An astronomic watch according to claim 1, wherein said display system also includes a planisphere representing the Earth seen from one pole and effecting one revolution every 24 hours in the anti-clockwise direction to indicate the half of the Earth which is in darkness and the half which is illuminated by the Sun at the time displayed by said hands.

12. The astronomic watch according to claim 1, wherein the selection of a heavenly body is effected by means of a rotating bezel forming part of said manual control system.

13. An astronomic watch according to claim 12, wherein said rotating bezel also allows the watch to be placed in an operating mode in which it is possible to select said other date by means of a rotating control stem with several axial positions which also forms part of said manual control system.

14. An astronomic watch according to claim 13, wherein said control stem also allows time-setting of the watch to be performed.

* * * * *